US007022178B1

(12) United States Patent
Steinhäuser

(10) Patent No.: US 7,022,178 B1
(45) Date of Patent: Apr. 4, 2006

(54) BINDING AGENT, CORE SAND MIXTURE AND A METHOD FOR PRODUCING THE SAME

(75) Inventor: Thomas Steinhäuser, Goch-Hommersum (DE)

(73) Assignee: Hydro Aluminium Deutschland GmbH, Bonn (DE)

( * ) Notice: Subject to any disclaimer, the term of this patent is extended or adjusted under 35 U.S.C. 154(b) by 109 days.

(21) Appl. No.: 10/111,624

(22) PCT Filed: Oct. 21, 2000

(86) PCT No.: PCT/EP00/10386

§ 371 (c)(1),
(2), (4) Date: Sep. 25, 2002

(87) PCT Pub. No.: WO01/30517

PCT Pub. Date: May 3, 2001

(30) Foreign Application Priority Data

Oct. 26, 1999 (DE) ..... 199 51 622

(51) Int. Cl.
*C04B 12/04* (2006.01)

(52) U.S. Cl. ..... 106/600; 106/603; 106/38.3; 106/38.35

(58) Field of Classification Search ..... 106/600, 106/603, 38.3, 38.35
See application file for complete search history.

(56) References Cited

U.S. PATENT DOCUMENTS

| | | | | |
|---|---|---|---|---|
| 3,442,665 A | * | 5/1969 | Muller et al. | 106/38.35 |
| 3,898,090 A | * | 8/1975 | Clark | 106/38.2 |
| 3,955,988 A | * | 5/1976 | Bosch et al. | 106/38.35 |
| 3,977,888 A | * | 8/1976 | Sano et al. | 427/344 |

(Continued)

FOREIGN PATENT DOCUMENTS

| | | | |
|---|---|---|---|
| CN | 1119206 | * | 3/1996 |
| CN | 1308106 | * | 8/2001 |
| CZ | 253072 | * | 10/1987 |
| DE | 53 277 | | 1/1967 |
| DE | 82 809 | | 6/1971 |
| DE | 29 09 107 A1 | | 9/1979 |
| DE | 19632293 A1 | | 2/1998 |
| DE | 196 35 173 C1 | | 4/1998 |

(Continued)

OTHER PUBLICATIONS

"Modern Methods for Manufacturing of Molds", pp. 45–46, R.O.C. Casting Association, Jan. 1990.
Decision for Taiwan Application No. 89122597.
Office Action for Japanese Application No. 11–316361.

*Primary Examiner*—Paul Marcantoni
(74) *Attorney, Agent, or Firm*—Darby & Darby

(57) ABSTRACT

A binding agent system based on water glass is disclosed, comprising an aqueous alkali silicate solution having the general composition: $xSiO_2 \cdot yM_2O \cdot zH_2O$, with M standing for the alkali ions $Li^+$, $K^+$, or $Na^+$, and a hygroscopic base, which is added in the ratio 1:4 to 1:6, with the modulus $Na_2O/SiO_2$ being equal to 2.5 to 3.5 at a proportion of solids of 20 to 40% and with 30% sodium hydroxide in an aqueous solution being used as the hygroscopic base. According to the present invention, the aqueous alkali silicate solution contains an emulsion solution having 8 to 10% silicone oil in relation to the quantity of binder, with the silicone oil having a boiling point≧250°. The quantity of binder for a core sand mixture is 1.0 to 2.5%, in relation to the total quantity of granular solid, with the production method being performed in a core shooter comprising a vertically positioned housing having a horizontal air intake. The core sand mixture is introduced via a funnel into a slotted sand cylinder. The connection between the funnel and the sand cylinder is closed during the shooting. The core sand mixture located in the slotted sand cylinder is compacted using an air pressure of $p_1$ and then shot into the core box at a pressure $p_2 > p_1$.

8 Claims, 1 Drawing Sheet

U.S. PATENT DOCUMENTS

| | | | | | |
|---|---|---|---|---|---|
| 4,162,238 | A | | 7/1979 | Bergna | 260/29.6 S |
| 4,212,677 | A | * | 7/1980 | Khmelev et al. | 106/38.35 |
| 4,361,696 | A | * | 11/1982 | Blount | 528/362 |
| 5,601,777 | A | | 2/1997 | Fischer et al. | 264/517 |

FOREIGN PATENT DOCUMENTS

| | | | |
|---|---|---|---|
| FR | 2464766 | | 3/1981 |
| GB | 857132 | | 12/1960 |
| GB | 1017744 | | 1/1966 |
| GB | 1332943 | | 10/1973 |
| GB | 2013121 | | 8/1979 |
| GB | 2016483 | | 9/1979 |
| GB | 1122307 | | 8/1988 |
| JP | 44-20721 | | 9/1944 |
| JP | 46-19579 | | 7/1945 |
| JP | 47-23320 B | | 6/1972 |
| JP | 47-23320 A | | 10/1972 |
| JP | 47-23320 U | | 11/1972 |
| JP | 53-144421 | | 12/1978 |
| JP | 58-9859 | | 1/1983 |
| JP | 02263775 | | 10/1990 |
| PL | 154838 | * | 9/1991 |
| PL | 174819 | * | 9/1998 |
| RU | 2177463 | * | 12/2001 |
| SU | 1710529 | * | 2/1992 |

* cited by examiner

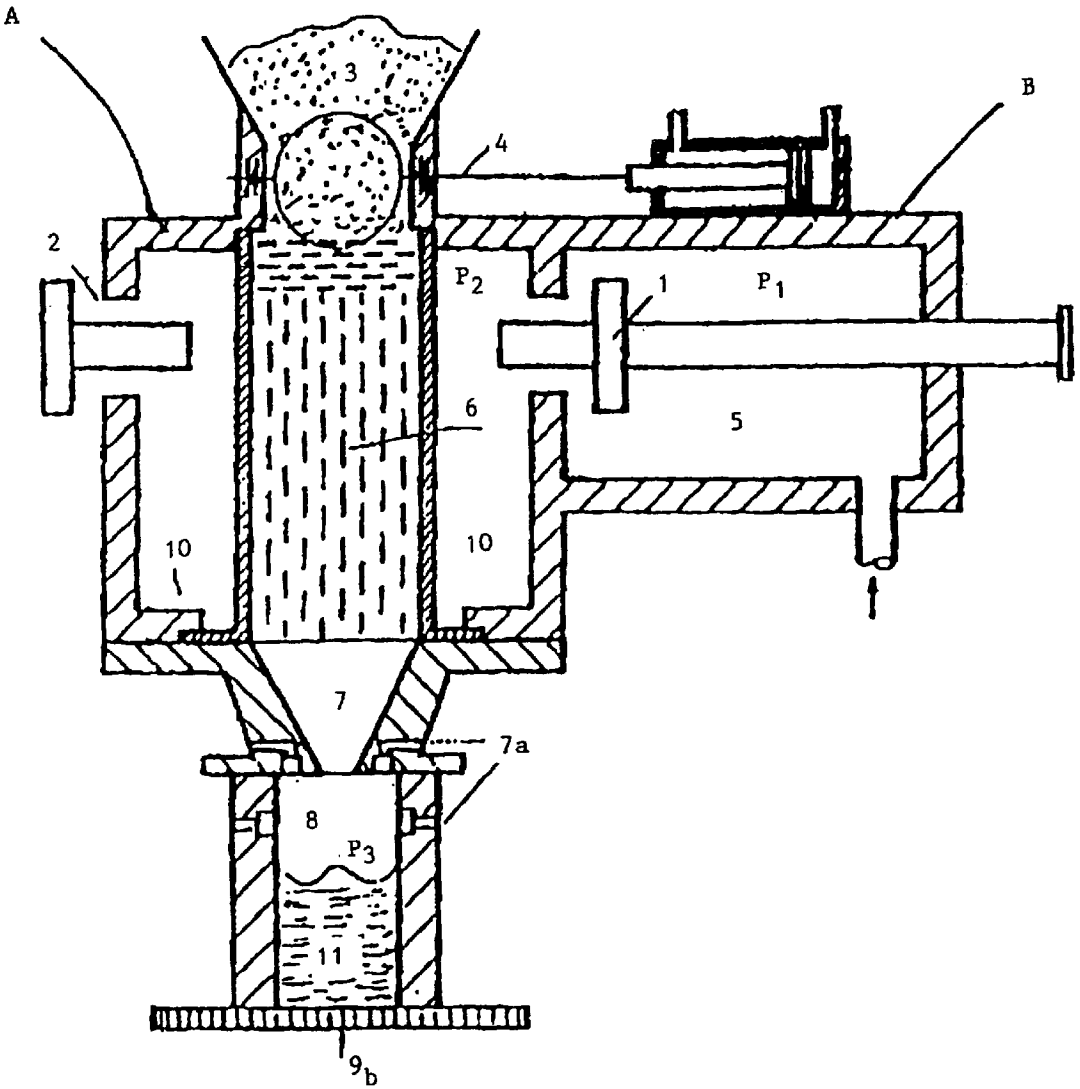
B
A
1
2
3
4
5
6
7
7a
8
9b
10
11
P1
P2
P3

BINDING AGENT, CORE SAND MIXTURE AND A METHOD FOR PRODUCING THE SAME

The present invention relates to a binding agent system based on water glass, comprising an aqueous alkali silicate solution having the general composition: $xSiO_2 \cdot yM_2O \cdot zH_2O$, with M standing for the alkali ions $Li^+$, $K^+$, or $Na^+$, and a hygroscopic base, which is added in the ratio 1:4 to 1:6, with the modulus $Na_2O/SiO_2$ being equal to 2.5 to 3.5 at a proportion of solids of 20 to 40% and with 30% sodium hydroxide in an aqueous solution being used as the hygroscopic base, as well as a core sand mixture and a method for its production.

The binder contained in the binding agent system is used to produce core moldings for foundry purposes. Binders are a component of a molding material which, under specific conditions, such as dampening or swelling and silicate formation, produces the bond between the individual grains of sand. In addition to pure swelling binders and ceramic binders, chemical binders based on water glass or an artificial resin are also used, which react with one another chemically and solidify at the same time.

The known binders are either not sufficiently stable or display undesired side effects or waste products, which endanger the environment. Therefore, water glass bonded molding materials, which form solid phases via dehydration and solidify at the same time, have been shown to be a reasonable compromise. However, it is not always simple to control the solidification processes in such a way that they first occur in the core box. The danger of early solidification of the mold sand particularly arises due to the use of modern core molding machines. Therefore, the good flow properties of the sand, which are required as it is poured into the core box, are not achieved.

A binding agent for raw mixtures for producing self-hardening casting molds and casting cores is known from German Published Application 15 08 634 (Diamond Shamrock Corp.). The binding agent comprises sodium silicate, using a mole ratio $Na_2O$ to $SiO_2$ of 1:1.5 to 1:3, and potassium hydroxide, which is added in the form of an aqueous solution. During the setting, hydrogen is released in an exothermic reaction, with the setting time being shortened by the addition of potassium hydroxide. An external supply of heat is not provided, with a further silicious material, e.g. ferrosilicon, having to be added, whose grain size is, however, to be below 0.15 mm. The rapid setting is therefore possible only under specific, strictly limited conditions and in the presence of multiple components, which must be controlled exactly.

To improve processability during the green sand casting method of water glass-bentonite or water glass-clay mixtures, 1.0 to 2.0% sodium hydroxide is added to a molding material mixture according to German Democratic Republic Patent 82 809. The molding material comprises, in addition to 2.0 to 5.0% sodium silicate, 0.5 to 1.0% starch and 2.0 to 4.0% clay, with the remainder quartz sand. The molding mass is applied to the model, backfilled with filler sand, and the finished green mold is chemically or thermally solidified. Therefore, these are green sand molds which are not suitable for mechanical core production. The sample bodies produced from this are hardened by esterification while being dried for 1 hour at 200° C. and then subjected to a compression test, with a maximum strength of 500 to 600 $N/m^2$ resulting. This maximum value was only achieved with a molding material in which the surface-active components did not exceed a total quantity of 0.1%, in relation to the total quantity of the material.

A method in the production of bodies made of granular and/or fibrous material using sodium silicate or potassium silicate as a binding agent is known from German Patent Specification 29 09 107, with a surface-active material being added to the mixture of the material. The surfactant material may comprise a surface-active, a silicone oil, or a silicone emulsion, at a quantity of at most 0.1%, in relation to the total quantity of material.

The object of the present invention is to develop a binding agent system for mechanical core production through core shooting/core blowing which may be easily processed in the dry process (in the dried, pulverized state) and has an improved flowability and reduced setting time at the same time.

This object is achieved according to the present invention by the features indicated in the patent claims.

The novel binding agent system based on water glass comprises an aqueous alkali silicate solution of the general composition: $xSiO_2 \cdot yM_2O \cdot zH_2O$, with M standing for the alkali ions $Li^+$, $K^+$, or $Na^+$, and is characterized in that it additionally contains a hygroscopic base. Sodium hydroxide is preferably used as the hygroscopic base in the ratio 1:4 to 1:6. If the modulus $Na_2O/SiO_2$ is equal to 2.5 to 3.5 at a proportion of solids of 20 to 40%, this prevents the mold sand from solidifying prematurely under all operating conditions. 30% sodium hydroxide in an aqueous solution is used as the hygroscopic base. A surface-active material is added to control the hygroscopic properties.

If silicone oil having a boiling point $\geqq 250°$ is added to the binding agent system as the surface-active material, the flowability of the mold sand in the core shooter may be increased significantly. An emulsion solution having 8 to 10% silicone oil, in relation to the quantity of binder, is added to the binding agent system, with the following advantageous refinements being possible:

a) the silicone emulsion solution has anionic, cationic, non-ionogenic properties,
b) an emulsifier is used in the emulsion solution which elevates the viscosity of the base oil and simultaneously reduces the surface tension of the binding agent system. The emulsifier has a hydrophilic and a lipophilic molecule part, which projects into the oil phase,
c) an oil is used as a base oil for the silicone emulsion solution which forms a sodium oleate film in the binding agent system, which generates a mechanically stable protective layer in the boundary surface of the dispersion system,
d) the silicone oil emulsion solution has the following structure:
   the Si atoms are each bonded to two $CH_3$ groups,
   the Si atoms are bonded to one another via oxygen atoms and form a chain, with the $CH_3$ groups of the respective neighboring Si atoms being positioned spatially displaceable around the oxygen atoms.

In the following, the present invention is described in more detail with reference to a comparative example. In this case, a core shooter as shown in FIG. 1 is used, which has the following design:

The core shooter comprises a vertically positioned housing A, onto which a horizontal air intake B is flange-mounted. The air intake is controlled via a large-surface air intake valve 1, with an elevated air pressure arising in air supply tank 5. When air intake valve 1 is opened, the air pressure reaches engine chamber 10 of housing A, in which a slotted sand cylinder 6 is positioned vertically. Sand cylinder 6 is connected to a sand supply container 3, which may be emptied via a slide valve 4.

If the air intake valve is operated, sand is conveyed from slotted sand cylinder 6 into shooting head 7 having a sand outlet opening and enters core box 8, with a core sand aspirator 9*a*, 9*b* ensuring the production of compacted core sand 11.

To assess the moisture content of the mold sand, a moisture meter is integrated into air exit valve 2. Using this arrangement, it was determined that with the implementation of the core sand according to the present invention, significantly higher moisture contents, and therefore better viscosity and better flowability, of the mold sand could be achieved.

The core sand mixture according to the present invention contains a quantity of binder from 1.0 to 2.5%, in relation to the total quantity of granular solid. The granular solid is preferably quartz sand having a grain size of 0.1 to 0.3 mm. The quantity of sodium hydroxide added to the binding agent system is 0.01 to 0.6% and 0.1 to 0.5% silicone oil is contained therein. In the following, a compressive strength test is performed using the binding agent according to the present invention.

Series 1, charge makeup:

2.4% binder, 0.4% emulsion, remainder quartz sand

Sample weight 158 g, sample body—standard height 50 mm 2 minutes of microwave drying after removal from the core shooter.

Testing after 30 minutes at room temperature.

Compressive strength: average value from 5 tests 1060 $N/cm^2$

Series 2, charge makeup:

2.4% binder, 0.4% NaCH, 0.2% silicone oil, remainder quartz sand

Sample weight: 157 g, sample body—standard height 50 mm 2 minutes of microwave drying after removal from the core shooter.

Compressive strength testing after 30 minutes at room temperature.

Average resistance value from 5 tests 1164 $N/cm^2$.

This comparative experiment showes that the binding agent systems according to the present invention may be processed into high-strength mold bodies using a typical core shooter. The test bodies had an approximately 10% improvement in compressive strength if 0.2% silicone oil was added to the test mixture. If the method according to the present invention according to claim 1 was used, the comprehensive strength could be increased even more.

I claim:

1. A binding agent for a core sand mixture used in foundry processes, comprising:

(a) a binder incorporating an aqueous alkali silicate solution containing 1. an alkali silicate having the formula $xSiO_2 \cdot yM_2O \cdot zH_2O$ wherein M is $Li^+$, $K^+$, or $Na^+$; and
2. a hygroscopic base, sodium hydroxide, in the ratio of one part of the base per 4 to 6 parts of the alkali silicate;

wherein the ratio of $Na_2O/SiO_2$ is 2.5 to 3.5 and the solids content is 20 to 40% of the solution; and, in admixture therewith;

(b) an emulsion containing a silicone oil having a boiling point of ≧250° in an amount of from 8 to 10% of the binder.

2. The binding agent according to claim 1, wherein the silicone oil has the following structure:

(c) Si atoms are each bonded to two $CH_3$ groups, (d) Si atoms are bonded to one another via oxygen atoms and form a chain wherein the $CH_3$ groups of the respective neighboring Si atoms are positioned spatially displaced around the oxygen atoms.

3. A core sand mixture for foundry purposes, comprising sand and the binding agent of claim 1 in an amount of 1.0 to 2.5% of the total quantity of sand.

4. The core sand mixture of claim 3, wherein the sand is quartz sand having a grain size from 0.1 to 0.3 mm.

5. The core sand mixture of claim 3, wherein the quantity of sodium hydroxide in the binding agent is 0.01 to 0.6% thereof.

6. The core sand mixture of claim 3, wherein the quantity of silicone oil in the binding agent is 0.1 to 0.5% thereof.

7. A method of producing a core sand mixture for foundry purposes, comprising the steps of:

(e) introducing the core sand mixture of claim 3 into a vertically positioned slotted sand cylinder;

(f) subjecting the core sand mixture within the slotted sand cylinder to elevated air pressure pi to compress the core sand mixture; and (g) feeding the compressed core sand mixture through a core shooter and into a core box at a pressure $p_2 > p_1$ to provide the core sand mixture.

8. The method of claim 7, where in step (c) the pressure $p_2$ within the core box is relieved by aspiration to release pressurized air and moisture.

* * * * *